US005266176A

United States Patent [19]

Muret et al.

[11] Patent Number: 5,266,176

[45] Date of Patent: Nov. 30, 1993

[54] BIPOLAR ELECTRODE FOR AN ELECTROLYZER

[75] Inventors: Frédéric Muret; Emile Cabaraux, both of Brussels, Belgium

[73] Assignee: Solvay (Societe Anonyme), Brussels, Belgium

[21] Appl. No.: 845,686

[22] Filed: Mar. 4, 1992

[30] Foreign Application Priority Data

Mar. 20, 1991 [BE] Belgium ..... 09100262

[51] Int. Cl.[5] ..... C25B 9/04

[52] U.S. Cl. ..... 204/268; 204/274; 204/279

[58] Field of Search ..... 204/241, 254, 268–270, 204/290 F, 292, 293, 250, 267, 289, 290 R, 288, 253, 255–258

[56] References Cited

U.S. PATENT DOCUMENTS

| | | | |
|---|---|---|---|
| 3,755,105 | 8/1973 | Messner | 204/95 |
| 3,826,732 | 7/1974 | Schultz et al. | 204/290 F |
| 3,884,792 | 5/1975 | McGilvery | 204/268 X |
| 3,992,279 | 11/1976 | Larsson | 204/268 X |
| 4,088,551 | 5/1978 | Raetzch et al. | 204/129 |
| 4,108,752 | 8/1978 | Pohto et al. | 204/256 |
| 4,734,180 | 3/1988 | Sato et al. | 204/254 |
| 5,141,619 | 8/1992 | Muret | 204/267 |

FOREIGN PATENT DOCUMENTS

| | | |
|---|---|---|
| 2434215 | 3/1980 | France . |
| 2027053 | 2/1980 | United Kingdom . |

*Primary Examiner*—Donald R. Valentine

*Attorney, Agent, or Firm*—Emmanuel J. Lobato; Robert E. Burns

[57] ABSTRACT

Bipolar electrode for an electrolyser of the series type, comprising two metal plates (1, 2) arranged in parallel facing each other, an electrically conductive solid mass (3) maintained under pressure between the two plates and a means for heating the solid mass to a temperature which is at least equal to its flow temperature. The bipolar electrode is suitable for electrolysers of the series type, in which sodium chlorate and hydrogen are produced by electrolysis of aqueous sodium chloride solutions.

1 Claim, 4 Drawing Sheets

BIPOLAR ELECTRODE FOR AN ELECTROLYZER

The invention relates to electrolysers of the series type, with bipolar electrodes.

It relates more particularly to a bipolar electrode intended for such electrolysers.

Electrolysers of the series type generally consist of a sequence of unit electrolysis cells separated by bipolar electrodes. Each unit cell comprises an anode and a cathode, and each bipolar electrode comprises a wall which is common to two adjoining unit cells and carries the anode of one of these two cells and the cathode of the other cell. For this purpose, the abovementioned common wall usually consists of two plates of different metals, welded to each other. In the case of electrolysers employed for the electrolysis of aqueous sodium chloride solutions, the plate carrying the anode is generally made of titanium, the other plate being made of iron, steel, nickel or of an alloy of these metals. The presence of a titanium plate welded to a plate of a different metal may result in difficulties in the use of the electrolyser. These difficulties are related to the generation of atomic hydrogen on the cathode during the electrolysis; a proportion of the atomic hydrogen migrates through the plates of the common wall and forms titanium hydride within the titanium plate, and this results in embrittlement of the latter. Moreover, there is a risk that molecular hydrogen will form at the junction of the plates of the metal wall, resulting in internal mechanical stresses which are liable to crack the plates or to break locally the weld joint ensuring their connection.

To overcome this disadvantage it has been proposed to place between the two plates a sheet of a barrier material which has the property of resisting a migration of atomic hydrogen as far as the titanium plate. Tungsten, zinc, boron, silicon, cadmium, carbon, germanium and aluminium (Patent BE-A-815,411) have been proposed as the barrier material. Although remedying the formation of titanium hydride, this solution does not avoid the formation of pockets of molecular hydrogen at the junction of the cathode plate and the sheet of barrier material.

Another idea has been to maintain a gap between the two plates of the vertical wall so as to provide a vertical chamber for the removal of hydrogen after its migration through the plate carrying the cathode (Patent US-A-4,088,551). In this known assembly the electrical connection between the two plates of the vertical wall which is common to the two cells is provided by means of metal contacts distributed at intervals over the surface area of the plates and welded to the latter. This bipolar electrode has the double disadvantage of having a high overall electrical resistance and of giving rise to a heterogeneous distribution of the electrical current over the surface of the plates during use in an electrolyser.

In Patent GB-A-2,027,053 the two plates of the electrode are arranged on both sides of a block of porous graphite, a film of a polymeric material is placed between the graphite block and each of the plates and the assembly is compressed to join the graphite block to the plates. The bipolar electrode thus obtained has a mediocre electrical conductivity. Furthermore, its construction is complicated.

The known bipolar electrodes just described have the common feature of involving welding or adhesive bonding operations, and this complicates their construction and adds to their cost. In most cases they are difficult or even impossible to dismantle in order to replace defective components of the electrode, for example to regenerate an active coating on the titanium anode.

The invention overcomes the abovementioned disadvantages by providing a bipolar electrode of novel design, which reconciles a low electrical resistance, an effective escape of a gas migrating to the inside of the common wall of the bipolar electrode and a simplified construction permitting fast and easy assembly and disassembly of the common wall of the bipolar electrode.

Consequently, the invention relates to a bipolar electrode for an electrolysis cell, comprising two metal plates arranged in parallel facing each other and connected together by an electrical coupling member, one of the plates carrying an anode and the other plate carrying a cathode; according to the invention the electrical coupling member comprises, on the one hand, an electrically conductive solid mass maintained under pressure between the two plates and, on the other hand, a means for heating the mass to a temperature which is at least equal to its flow temperature.

In the electrode according to the invention the two metal plates and the solid mass constitute the abovementioned common wall of the bipolar electrode. The anode and the cathode may consist, at least partially, of the plates, or else they may comprise metal components, for example sheets, fastened to the plates as suggested in Patent US-A-4,088,551. The plates must be made of an electrically conductive material capable of withstanding the mechanical, thermal and chemical conditions which normally prevail in the electrolysers for which they are intended. For example, when they are intended for electrolysers for the electrolysis of aqueous sodium chloride solutions, the plate carrying the anode may be made of a film-forming metal chosen from titanium, tantalum, niobium, zirconium and tungsten, and the plate carrying the cathode may be made of a substance chosen from iron, nickel, cobalt and the alloys of these metals. In the case where the plate of film-forming metal constitutes at least a part of the anode, this plate is covered, over at least a part of its surface area, with an electrically conductive coating exhibiting a low overvoltage in the oxidation of the chloride ions. This coating may be, for example, chosen from metals of the platinum group (platinum, ruthenium, rhodium, palladium, iridium, osmium), alloys of these metals and their oxides; it may advantageously comprise mixed crystals of oxide of a metal of the platinum group and of oxide of a film-forming metal.

Both plates of the bipolar electrode are arranged facing each other and applied under pressure against an electrically conductive solid mass which is arranged between them. The solid mass has the special feature of flowing as soon as its temperature reaches a critical value, which is higher than the temperature reached in the said mass during the normal use of the electrode in an electrolysis process.

The means of heating is any device capable of heating the solid mass to a temperature equal to or higher than its flow temperature, as soon as the electrical resistance between the two plates exceeds a predetermined critical value.

According to a first embodiment of the invention the means of heating may consist, for example, of a pipe coil which is arranged around or inside the solid mass and which carries a heating fluid, for example super-heated steam. Alternatively, the means of heating may also comprise a heating apparatus using electrical induction.

In this embodiment of the invention the means of heating may be controlled by a measurement of the electrical resistance of the electrode or by a measurement of another parameter related to the electrical resistance, for example the electrical voltage or the temperature. When the electrode is being employed in an electrolysis process, if a gas pocket becomes formed between the mass and at least one of the plates, the overall electrical resistance of the electrode increases as a function of the volume of the gas pocket and, as soon as it reaches a critical value, the means of heating comes into action to make the solid mass flow, and the latter is then deformed under the effect of the pressure exerted by the plates, allowing the gas pocket to escape; this results in an immediate decrease in the resistance of the electrode and a corresponding decrease in its temperature, which thus falls back below the critical value. The, electrically conductive solid mass consequently fulfils a twin function: on the one hand, it is used to provide an electrical connection between the two plates; on the other hand, it ensures a removal of the gas pockets which could form between the metal plates and the solid mass.

In a particular embodiment of the electrode according to the invention the means of heating the solid mass consists of the Joule effect generated during the use of the electrode in an electrolysis process. In normal use of the electrode in an electrolyser operating under normal conditions, the heat released by the Joule effect in the solid mass is insufficient to reach the flow temperature therein. If a gas pocket happens to form at the interface between the solid mass and one of the plates the overall resistance of the electrode increases as a function of the volume of the gas pocket and the heat released by the Joule effect in the solid mass increases proportionally up to a value at which the temperature of the solid mass equals or exceeds the flow temperature.

Everything else being equal, the choice of the solid mass depends on the flow temperature of the latter, which is itself defined as a function of the construction characteristics of the electrode (especially of the dimensions of the plates and of their electrical resistivity) and of the normal conditions of use for which it is designed (especially the electrical current density and the temperature prevailing in the electrolyser). In general, in the case of bipolar electrodes intended for the electrolysis of aqueous solutions, it is suggested that a solid mass whose flow temperature lies between 75 and 200° C. should be chosen, temperatures between 100 and 150° C. being the most suitable. Furthermore, once the flow temperature is reached, the escape of a gas pocket from the solid mass will depend on various parameters (viscosity of the solid mass, density of the solid mass, relative density of the gas, volume of the gas pocket, pressure exerted by the plates on the solid mass). The choice of a pressure of between 1000 and 3000 MPa at the flow temperature is recommended, the values between 1500 and 2000 MPa being the most suitable.

The solid mass placed between the two plates may be a metal mass or a mass of a thermoplastic polymer containing an electrically conductive filling substance, for example metal particles or carbon fibres.

In a particular embodiment of the electrode according to the invention a metal mass is used, whose melting temperature is equal to the temperature of the means of heating. In this embodiment of the electrode according to the invention the solid mass must be enclosed in a receptacle which is integrally attached to the plates and which is intended to retain the mass when, the latter is in the molten state.

In accordance with another embodiment of the invention it is preferable to use a solid mass which flows in the pasty state at the temperature of the means of heating. Lead and lead alloys constitute examples of solid masses which can be employed in this embodiment of the electrode according to the invention.

In the bipolar electrode according to the invention the two plates must be integrally attached to a common frame or to each other so as to compress the solid mass between them. To this end, in a preferred embodiment of the electrode according to the invention the two plates are joined together by tie rods kept under tension. In this embodiment the tie rods may be metal bars welded to the plates. It is preferred, however, to make use of an assembly technique using nuts and bolts.

The bipolar electrode according to the invention has the appreciable advantage of being capable of being easily and rapidly dismantled and reassembled when, for example, it is found necessary to replace a defective anode or cathode. Furthermore, it has the advantageous feature of allowing less strict tolerances insofar as the machining of the plates and of the solid mass is concerned; in fact, when an electrode exhibiting considerable imperfections in the contact between the plates and the solid mass is first brought into use, these imperfections cause a momentary rise in the electrical resistance and an accompanying flow of the solid mass, which compensates the said imperfections.

The electrode according to the invention is intended especially for fitting to electrolysers of the series type, with bipolar electrodes.

The invention consequently also relates to an electrolyser of the series type comprising a sequence of unit electrolysis cells separated by bipolar electrodes in accordance with the invention, each of the said bipolar electrodes comprising two vertical metal plates which are arranged facing each other, on both sides of an electrically conductive solid mass kept under pressure between the two plates and comprising a means for heating the said mass to a temperature which is at least equal to its flow temperature, one of the plates carrying an anode of one of the unit cells and the other plate carrying a cathode of the neighbouring unit cell.

In the electrolyser according to the invention the two plates of each bipolar electrode and the solid mass situated between them constitute a wall which is common to two consecutive unit electrolysis cells.

The electrolyser according to the invention is especially suited for the processes of electrolysis of aqueous solutions of alkali metal halides, especially of sodium or potassium chloride. It finds an advantageous application for the production of hydrogen and of aqueous solutions of sodium chlorate by electrolysis of aqueous sodium chloride solutions. It finds another advantageous application for the production of chlorine, hydrogen and aqueous sodium hydroxide solutions by electrolysis of aqueous sodium chloride solutions. In this other application of the electrolyser according to the invention each of the unit electrolysis cells is divided into two electrolysis chambers, anodic and cathodic respectively, by a diaphragm which is permeable to gases and to electrolytes or by a membrane which is selectively permeable to cations.

Special features and details of the invention will appear in the course of the following description of the attached drawings, which show embodiments of the bipolar electrode and of the electrolyser according to the invention.

In these figures the same reference numbers indicate identical components.

Figure 1:
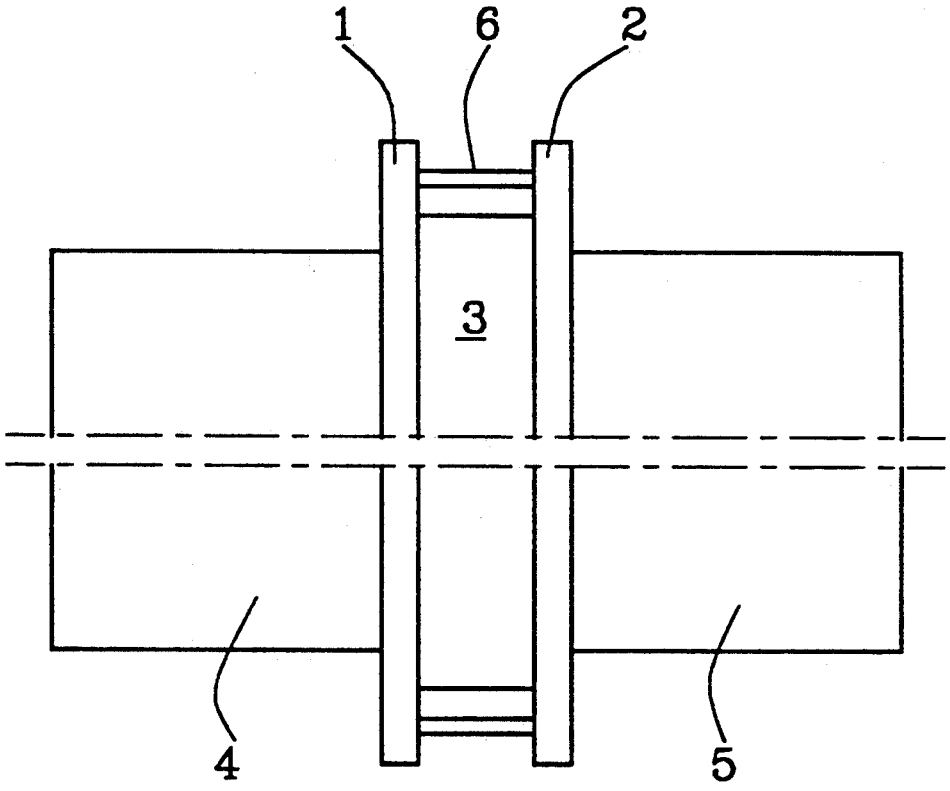
FIG. 1 is an elevation view of a particular embodiment of the bipolar electrode according to the invention.
Figure 2:
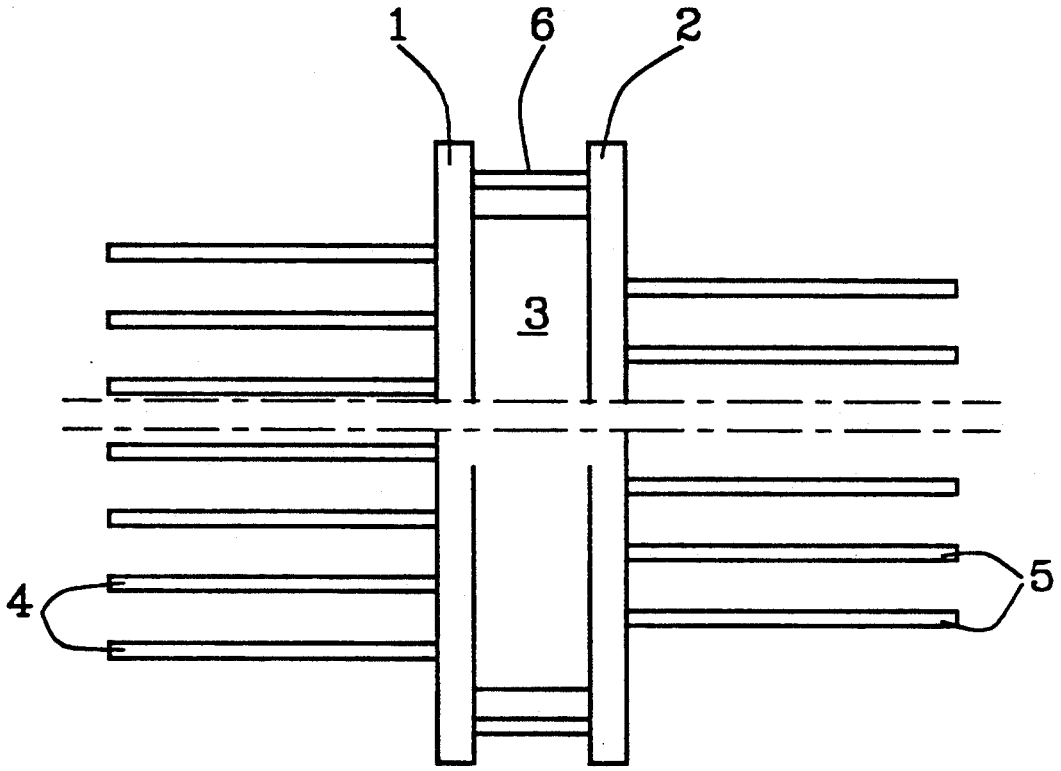
FIG. 2 is a plan view of the bipolar electrode of FIG. 1.

The bipolar electrode shown in FIGS. 1 and 2 comprises two parallel metal plates 1 and 2 arranged on both sides of a metal mass 3 which is solid at room temperature. Plate 1 is made of titanium and carries an anode consisting of a series of parallel metal sheets 4 welded perpendicularly to the plate 1. The sheets 4 are made of titanium and carry a coating consisting of mixed crystals of ruthenium oxide and titanium oxide. Plate 2 is made of steel and carries a cathode consisting of a series of parallel metal sheets 5 made of steel, welded perpendicularly to the plate 2. The two plates 1 and 2 are connected together by tie rods 6. The purpose of the latter is to apply the plates 1 and 2 against the metal mass 3 while exerting a defined pressure on the latter The securing of the tie rods 6 to the plates 1 and 2 may be carried out by any suitable means capable of withstanding the traction which is applied in order that the plates 1 and 2 may exert the desired pressure on the metal mass 3, for example a pressure of between 1500 and 2500 MPa. To this end, the tie rods 6 may be secured to the plates 1 and 2 by welding. It is preferred, however, to employ an assembly technique using nuts and bolts, to facilitate the dismantling of the plates and of the metal mass.

The purpose of the metal mass 3 is to form an electrical connection between the plates 1 and 2. It is chosen to be of a substance which is capable of flowing when subjected to a temperature of between 100 and 200° C. and a pressure of between 1500 and 2500 MPa, for example lead.

Figure 3:
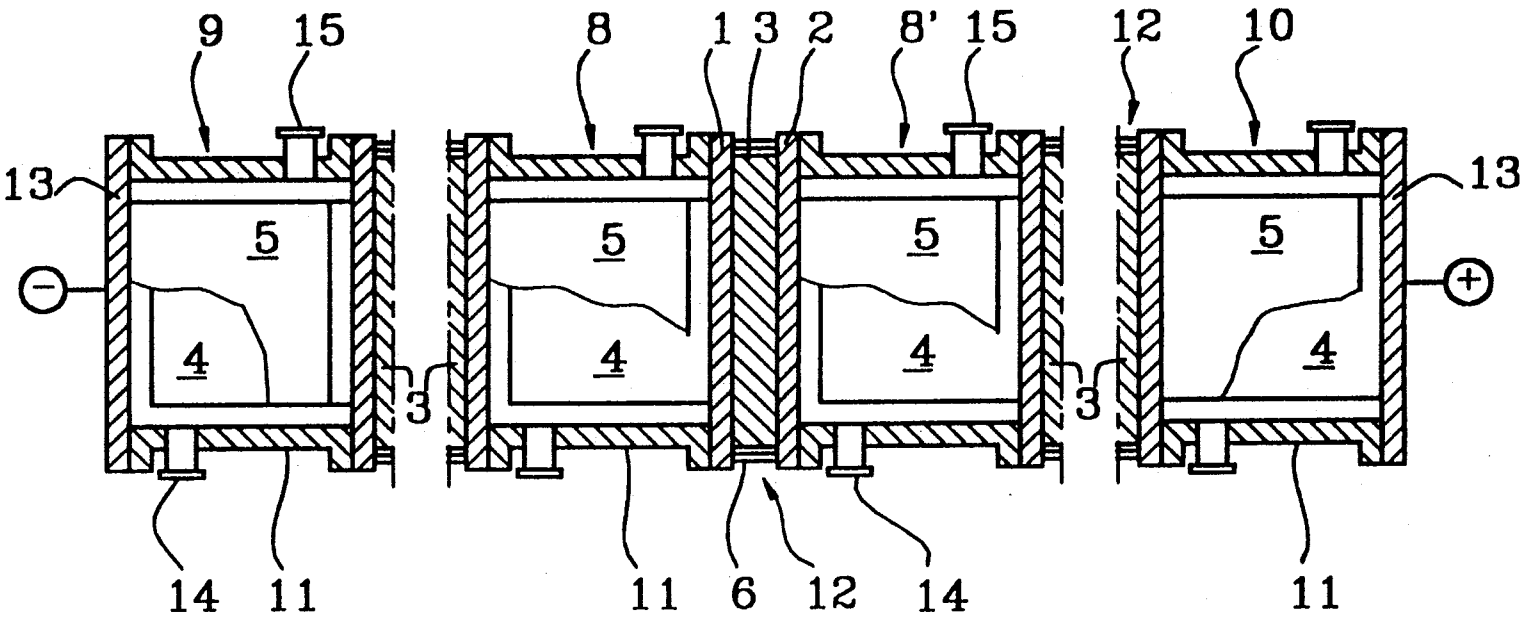
FIG. 3 shows, in lengthwise vertical section with partial cutaways, an embodiment of the electrolyser according to the invention.

The electrolyser shown in FIG. 3 is designed for the manufacture of aqueous sodium chlorate solutions by electrolysis of aqueous sodium chloride solutions It comprises unit cells 8, 8', etc, placed side by side between two end unit cells 9 and 10. The cells 8, 8' comprise an electrolysis chamber bounded by a horizontal side wall 11 of rectangular section and two end walls 12 which are common to two adjoining cells. The two end cells 9 and 10 also comprise a horizontal side wall 11, an end wall 12 placed between it and the adjoining cell 8 or 8' and an end wall 13 connected to a source of direct current, not shown. Two pipes 14 and 15, in communication with the electrolysis chamber, are intended to be connected, one to a general entry manifold for an aqueous sodium chloride solution, the other to a general discharge manifold for the products of the electrolysis.

In the electrolyser of FIG. 3 the end walls 12 are in accordance with those shown in FIGS. 1 and 2 and described above. They comprise a pair of vertical plates 1 and 2 connected by tie rods 6 and a lead mass 3 compressed between the plates 1 and 2 under the effect of the tie rods which are under mechanical tension. A series of vertical metal sheets 4 are secured transversely to the plate 1 and a series of vertical metal sheets 5 are secured transversely to the plate 2. The sheets 4 constitute the anode of one of the cells and the sheets 5 constitute the cathode of the adjoining cell. The end wall of the cell 9 also comprises a series of metal sheets 5 which constitute the cathode of this cell. The wall 13 of the end cell 10 carries a series of metal sheets 4 which constitute the anode of this cell 10. In each of the cells 8, 8', 9 and 10 the anode sheets 4 alternate with the cathode sheets 5.

Figure 4:
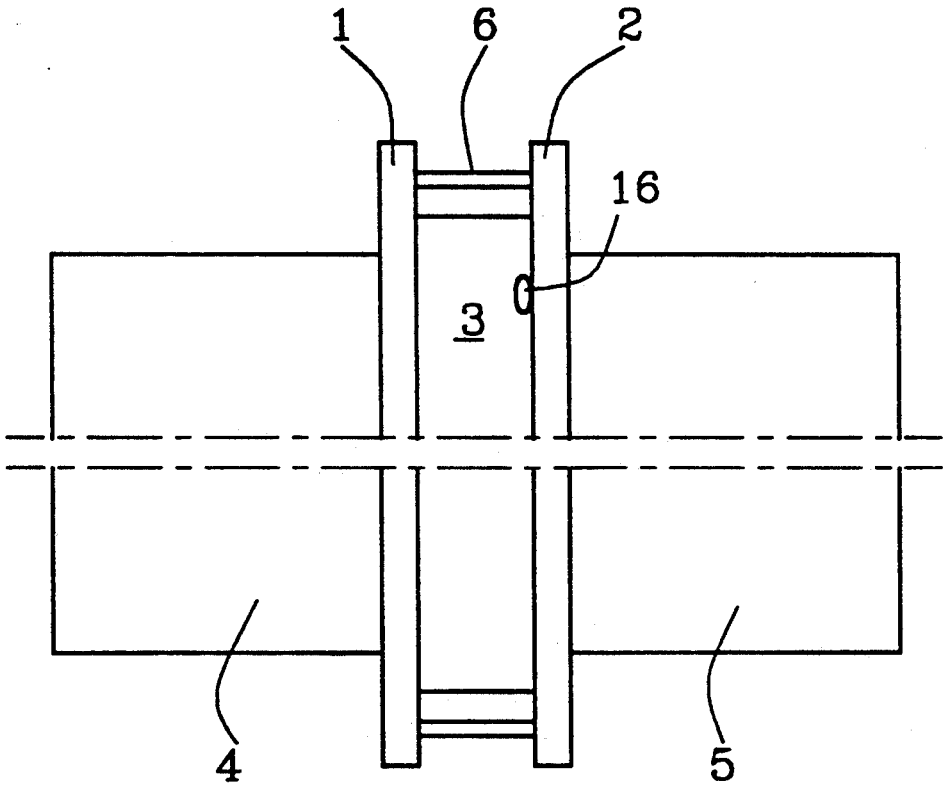
FIG. 4 is a view similar to FIG. 1, of a bipolar electrode of the electrolyser of FIG. 3 while in operation.

During the operation of the electrolyser shown in FIG. 3 an aqueous sodium chloride solution is introduced into the electrolysis cells 8, 8', 9 and 10 via the pipes 14 and the end cells 13 are connected to the terminals of a source of direct current, not shown In the bipolar electrodes 12, the lead mass 3 ensures the transfer of the electrical current. The sodium chloride solution undergoes electrolysis in cells 8, 8', 9 and 10, and an aqueous sodium chlorate solution and hydrogen generated on the sheets 5 of the cathodes are collected via the pipes 15. If atomic hydrogen diffuses through the plate 2 and happens to reach the interface of the plate 2 and of the lead mass 3, it forms there a hydrogen pocket 16, which can be seen in FIG. 4. This results simultaneously in an increase in the pressure acting on the lead mass 3, an increase in the electrical resistance of the assembly and, consequently, a dissipation of additional heat by the Joule effect in the lead mass 3, which heats up. As soon as the temperature of the lead mass becomes sufficient to cause it to flow, the hydrogen pocket 16 is forced away from the interface. This results in a decrease in the electrical resistance and a cooling of the lead mass, which consequently ceases to flow.

We claim:

1. A bipolar electrode for an electrolyser of the series type comprising:

two metallic plates disposed parallel with major side surfaces thereof facing toward each other;

an anode carried by one of said plates;

a cathode carried by another of said plates;

an electrically conductive coupling member disposed between said plates in close contact therewith;

said coupling member constituting a solid mass coupling said plates electrically;

means for effectively holding the two plates in close contact with said solid mass and for applying the plates with pressure against the coupling member therebetween;

said electrically conductive solid mass being under pressure between one thousand and three thousand MPa at its flow temperature; and means for applying heat to said solid mass independently of heat released during electrolysis.

* * * * *